United States Patent [19]

Ikeda

[11] 4,323,170

[45] Apr. 6, 1982

[54] CLEANING MATERIAL SUPPLYING APPARATUS WITH CLEANING MATERIAL STORING VESSEL CONTROLLED BY LID POSITION

[75] Inventor: Yoshio Ikeda, Aichiken, Japan

[73] Assignee: Tokyo Shibaura Denki Kabushiki Kaisha, Kawasaki, Japan

[21] Appl. No.: 156,346

[22] Filed: Jun. 4, 1980

[30] Foreign Application Priority Data

Jun. 26, 1979 [JP] Japan ..... 54-080494
Sep. 10, 1979 [JP] Japan ..... 54-115869

[51] Int. Cl.[3] ..... B67D 5/08

[52] U.S. Cl. ..... 222/70; 68/17 R; 134/93; 222/166

[58] Field of Search ..... 222/70, 129, 164, 166, 222/454, 456; 134/93, 95, 100, 101, 58 D; 68/17 R, 207

[56] References Cited

U.S. PATENT DOCUMENTS 2,709,536 5/1955 Yeager ..... 222/166
3,300,096 1/1967 Perl ..... 222/166
3,419,192 12/1968 Wrightenberry ..... 222/166

*Primary Examiner*—Gil Weidenfeld
*Assistant Examiner*—Fred A. Silverberg
*Attorney, Agent, or Firm*—Cushman, Darby & Cushman

[57] ABSTRACT

An apparatus for dispensing cleaning material such as soap, bleach, dye or the like, into the tub of a washing machine including a vessel which receives the material to be dispensed and is pivotably mounted for movement between a horizontal position and a tilted position in which the material is dispensed. A latch is released by the machine timer to permit movement to the dispensing position aided by a spring. Upon opening of the lid covering the opening through which the material is supplied to the vessel, the vessel is returned to its horizontal position and held by the latch.

8 Claims, 15 Drawing Figures

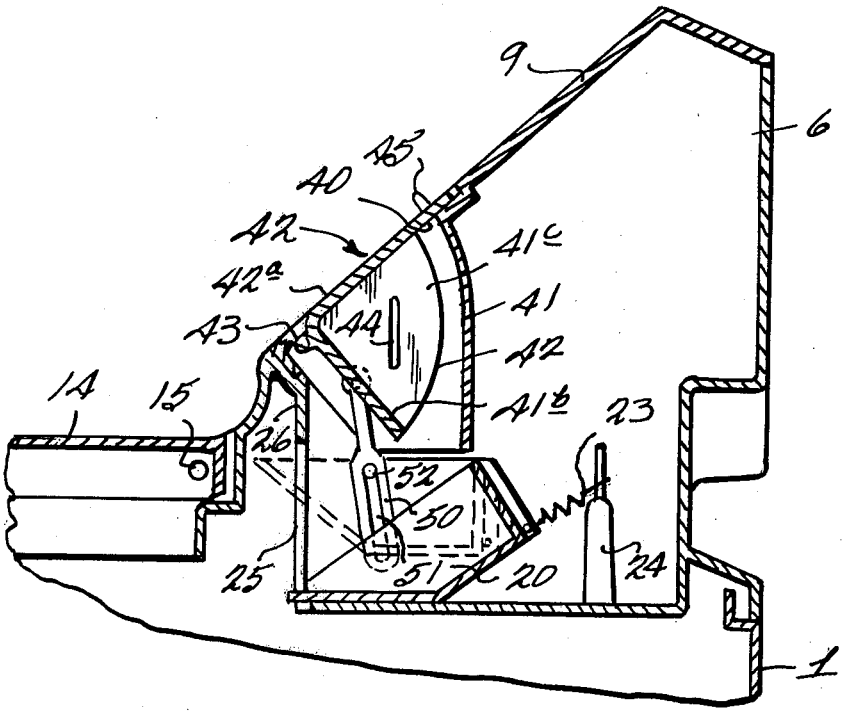
FIG. 3
FIG. 4
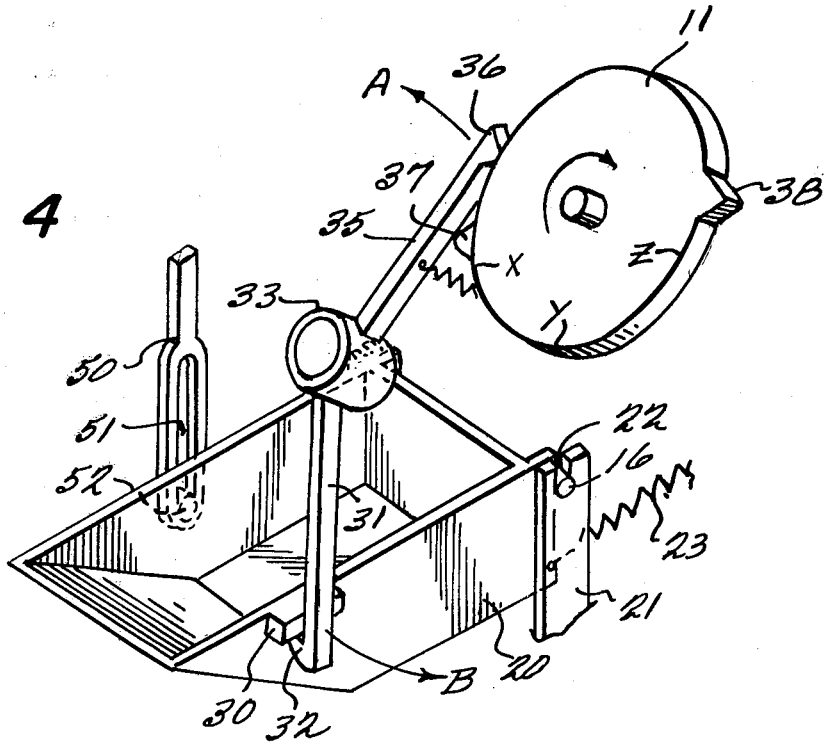

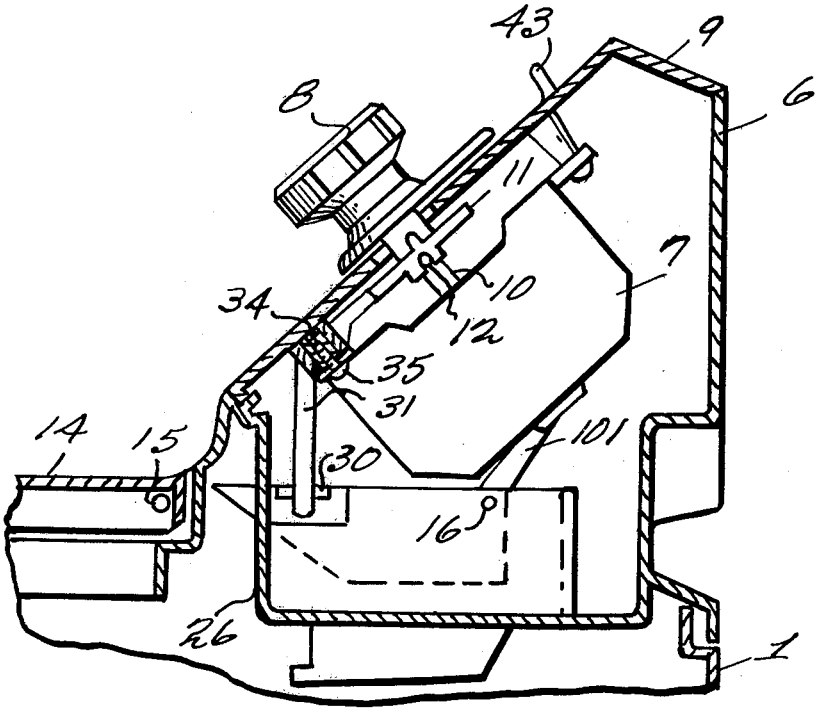
FIG. 6
FIG. 7
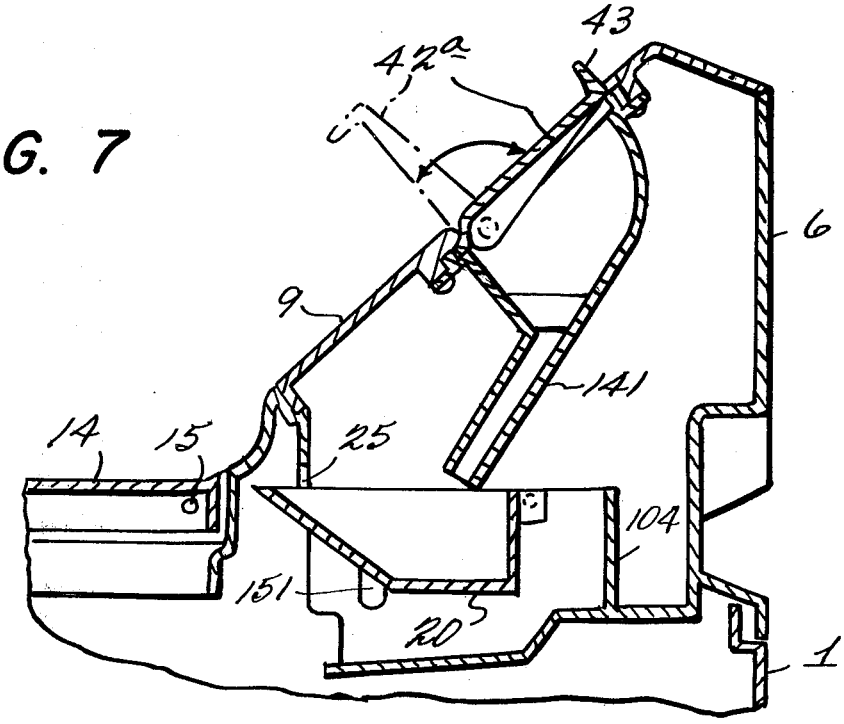

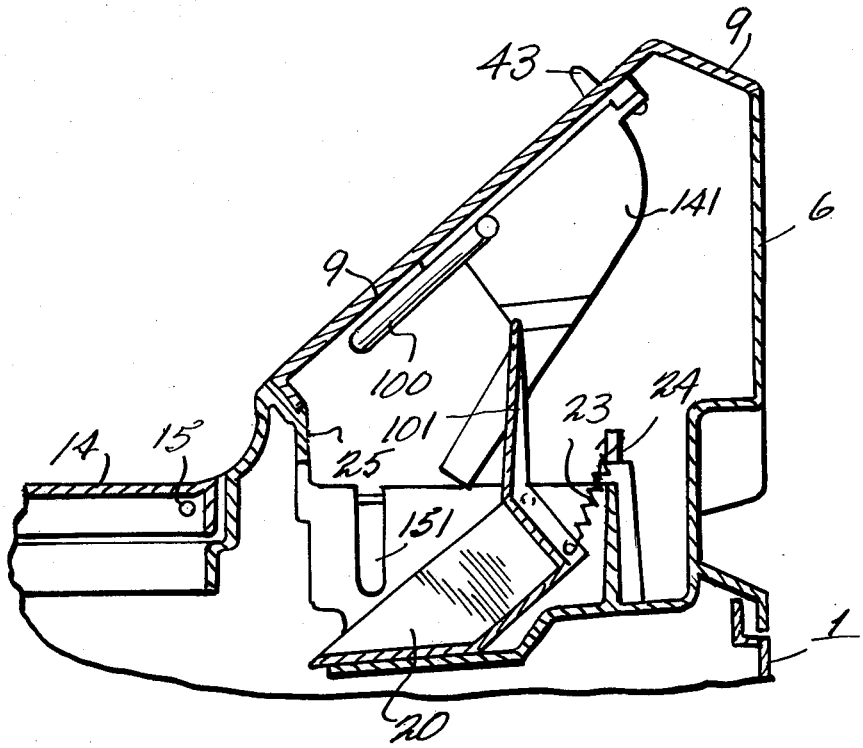
FIG. 8
FIG. 9
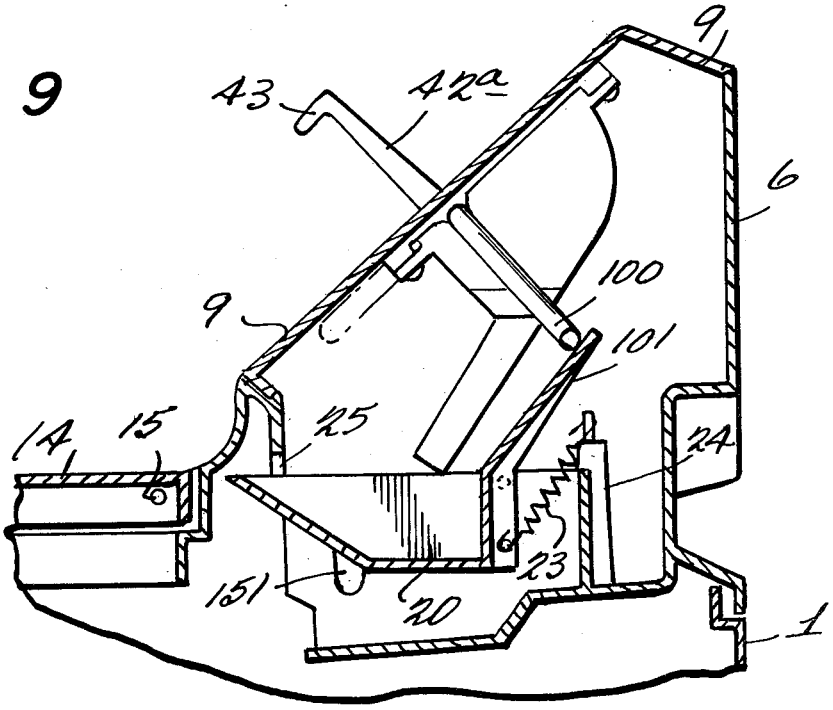

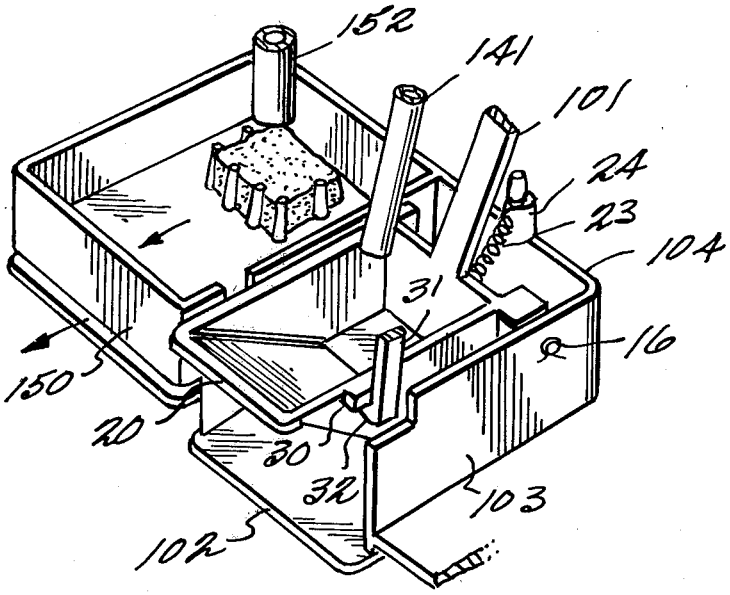
FIG. 10
FIG. 11
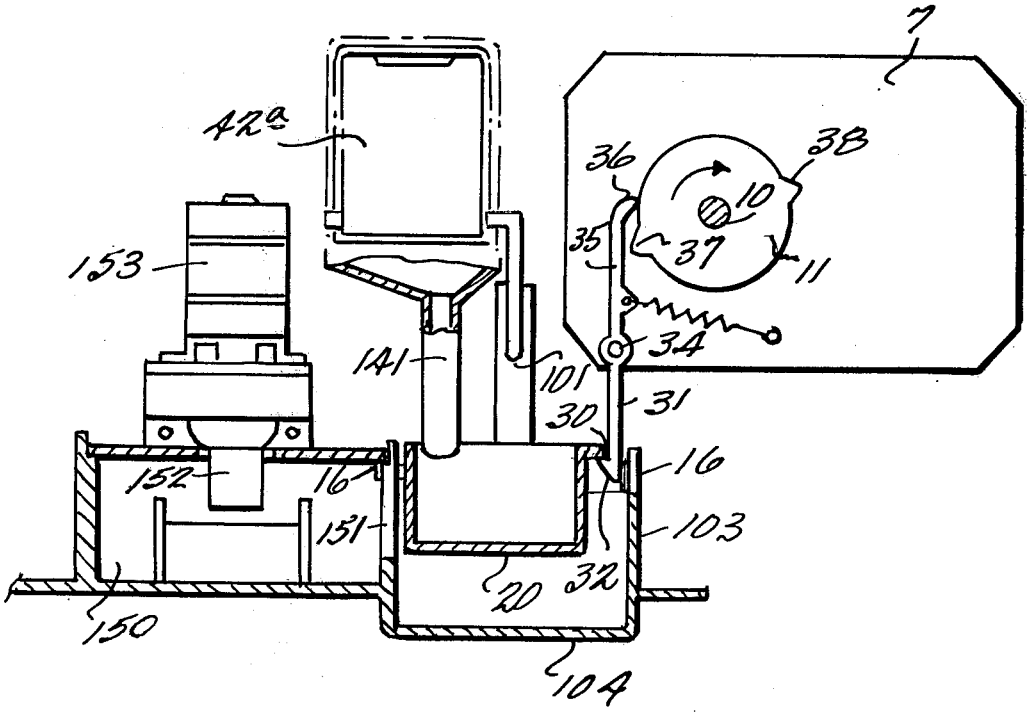

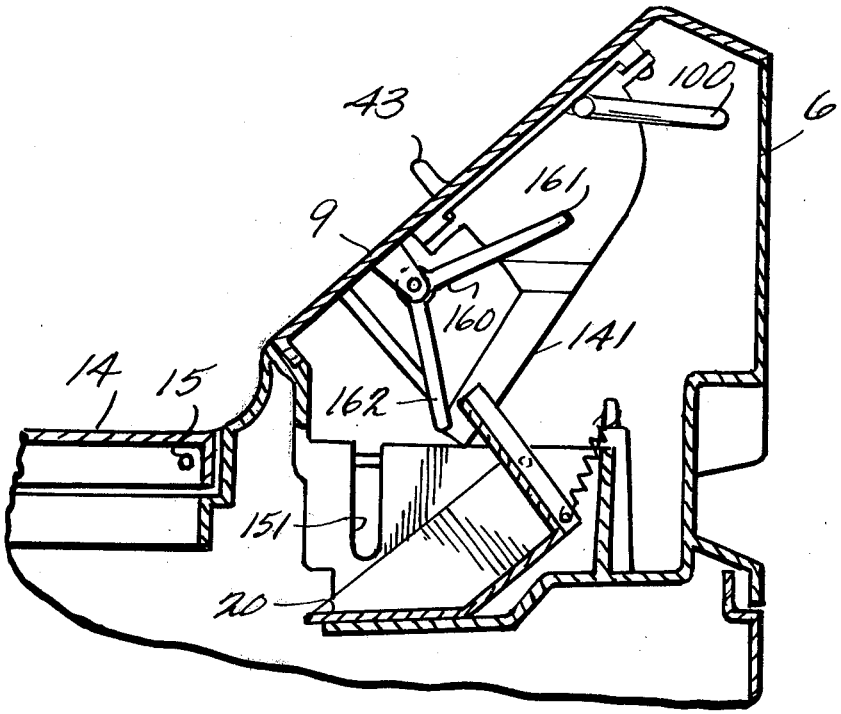
FIG. 13
FIG. 14
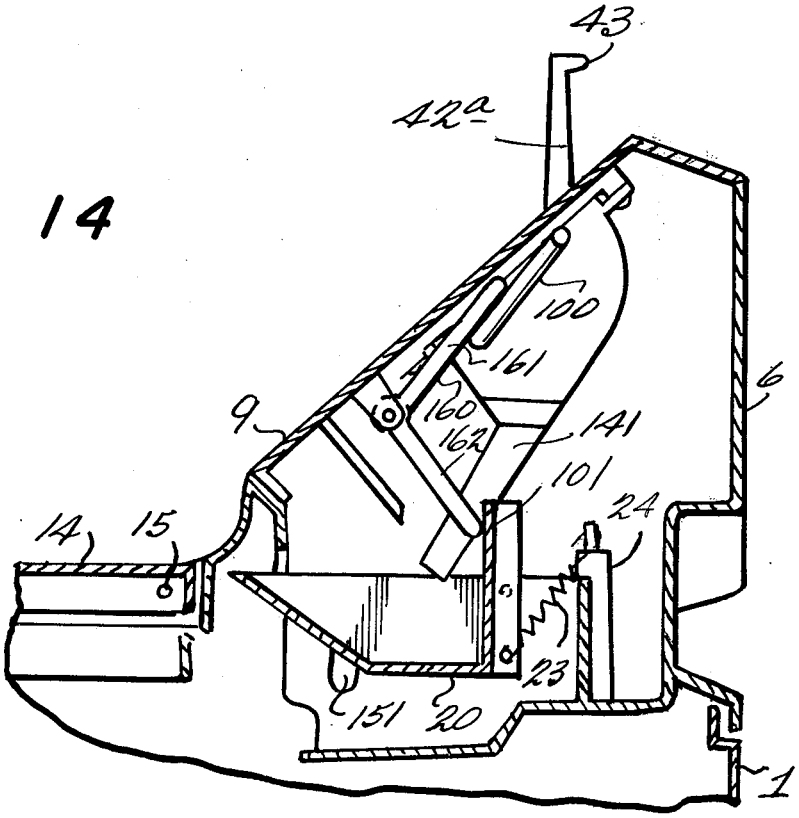

CLEANING MATERIAL SUPPLYING APPARATUS WITH CLEANING MATERIAL STORING VESSEL CONTROLLED BY LID POSITION

BACKGROUND OF THE INVENTION

This invention relates to a cleaning material supplying apparatus, such as a soap dispenser for a washing machine. Conventionally, each washing machine and the like has a soap dispensing apparatus. Such apparatus is installed in a control box disposed on the tub of the washing machine, and it has a vessel for storing soap, bleach, dye or the like and for releasing such materials into the tub.

Conventionally, the vessel is rotated to tilt down its one end so as to release such cleaning material and must be manually returned to an original or unused position where the material is to be stored for subsequent use. For this purpose, one end of the vessel extends from the inner surface of the tub to an opening where an object being washed therein is thrown.

However, this extended portion of the vessel is an obstacle when objects are taken in or out of the tub.

SUMMARY OF THE INVENTION

The object of the present invention is to provide an improvement in cleaning material supplying apparatus for ready operation.

According to the present invention, the just mentioned object is achieved by a lid for an opening on a control box in which a vessel for storing the cleaning material is contained and a mechanism for returning the vessel to an original position in which cleaning material is ready to be stored therein or be released therefrom in association with opening of the lid.

Other objects and features of the present invention will be apparent from the following description taken in connection with the accompanying drawings, in which:

FIGS. 2 and 3 show various sectional views of the cleaning material supplying apparatus of the washing machine as shown in FIG. 1;

FIG. 4 shows a perspective view of a part of the cleaning material supplying apparatus as one embodiment of the present invention;

FIGS. 6 to 9 show various sectional views of the cleaning material supplying apparatus as a second embodiment of the present invention;

FIG. 10 is a perspective view of a portion of the dispensing vessel and the actuating and self-cleaning means of the second embodiment;

FIG. 11 is an elevational view partially in section of the dispensing vessel and the actuating and self-cleaning mechanism shown in the second embodiment;

FIGS. 12 to 14 show various sectional views of a third embodiment of the present invention;

DETAILED DESCRIPTION OF THE DRAWINGS

Figure 1:
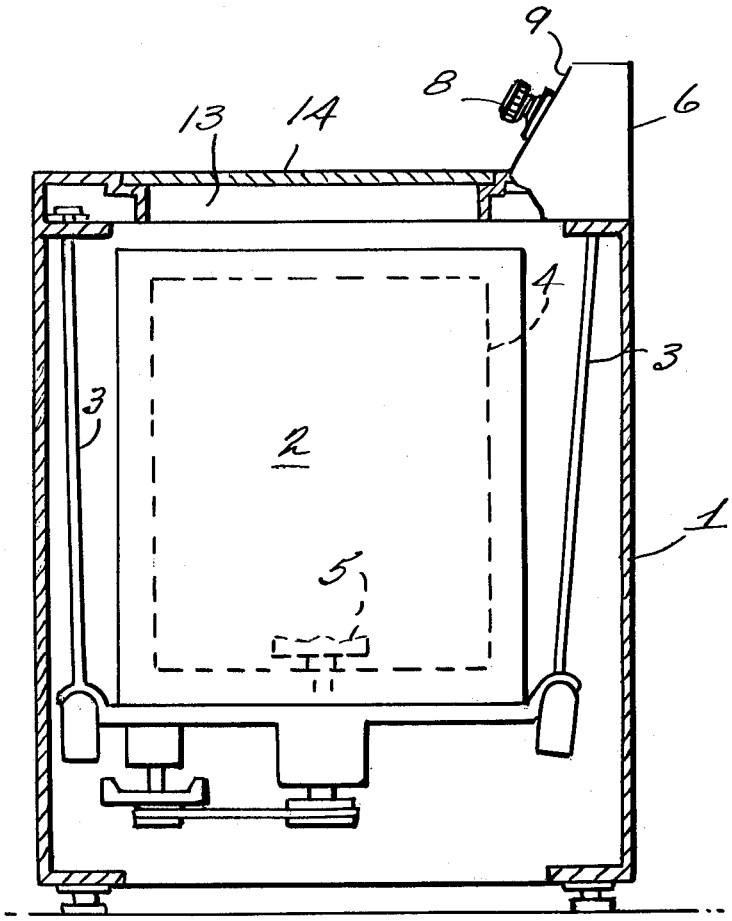
FIG. 1 shows a partial sectional view of a washing machine in which a cleaning material supplying apparatus as one embodiment of the present invention is mounted.

FIG. 1 shows a view of an automatic washing machine as an embodiment of the invention applied thereto. The machine shown in FIG. 1 includes an outer housing 1, a water receiving tub 2, a support member 3 vertically supporting tub 2 within case 1, a washing and dehydrating tub 4 rotatably installed in the receiving tub 2 and an agitator 5.

On the top of the machine is provided a control box 6 with a housing in which a conventional timer 7 for setting the operational time for washing, rinsing and dehydrating is contained.

Figure 2:
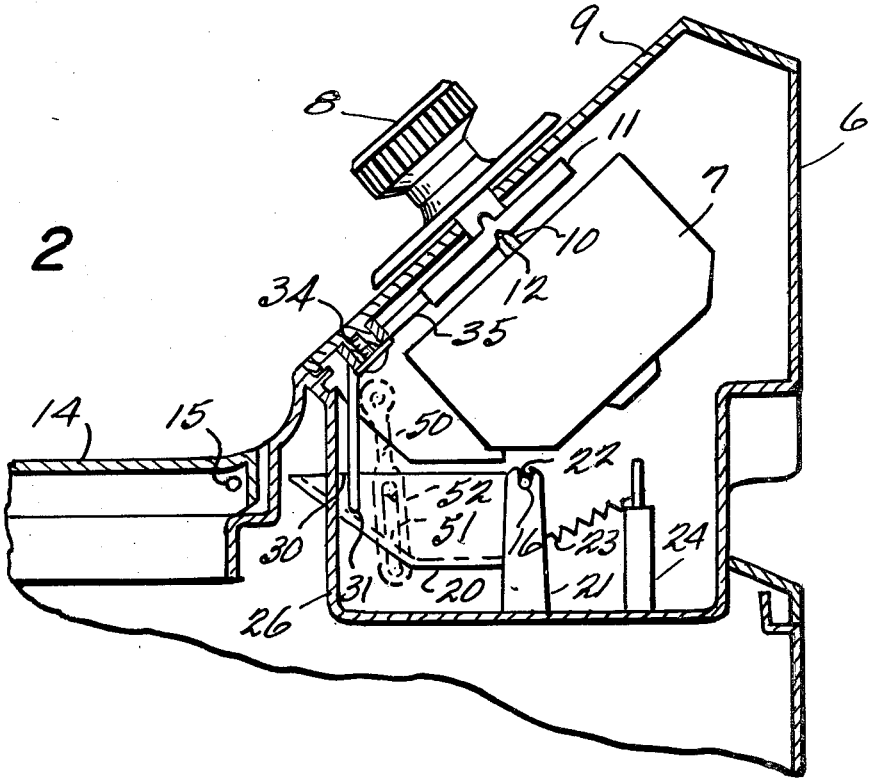
Figure 5:
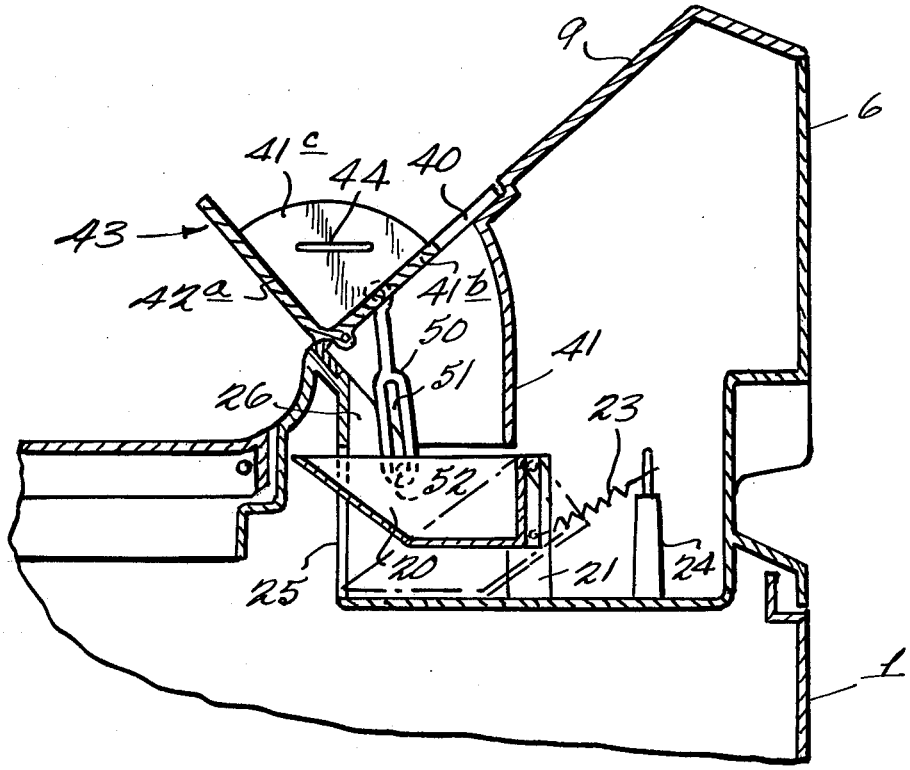
FIG. 5 shows a sectional view of the apparatus with the lid open.

Timer 7 is set by a dial 8 rotatably mounted on a panel 9, as shown in FIG. 2. A rotary shaft 10 of dial 8 is connected to a cam 11 by a pin member 12 and also is connected to a mechanism (not shown) of the timer 7 in a conventional manner.

An opening 13 through which an object to be washed, rinsed and dehydrated is thrown is covered with a plate-like lid 14. Lid 14 is hinged by shafts 15 attached to each side thereat.

In control box 6, a vessel 20 for storing cleaning material is installed. Cleaning material herein described includes materials for cleaning, rinsing, bleaching, dyeing or the like.

A rear portion of vessel 20 where pins 16 are fixed is supported by a pair of posts 21. Each of pins 16 is received and hinged at recesses 22 provided on top of the posts 21, respectively. A coil spring 23 is suspended between near bottom of the rear portion of the vessel 20 and a pillar 24 so as to urge vessel 20 to rotate about the pins 16 from a horizontal position to a dispensing position.

As shown in FIG. 3, an opening 25 is provided on a side wall 26 of control box 6 for permitting a front portion of vessel 20 to be extended therethrough.

A projection 30 provided on a side portion of the vessel 20 is to be engaged with one end of a lever 31 with a barb 32 (FIG. 4). At the other end of lever 31 is a hollow body 33 loosely joined to a shaft 34 for rotating lever 31 thereabout. A lever 35 of which one end is formed as a cam follower 36 is also fixed to the body 33 so that the lever 31 is moved in a different direction from that of lever 35. That is, if the lever 35 is moved up in the direction indicated by an arrow A by cam 11, specifically its expanded portions 37 or 38, lever 31 is moved in the direction indicated by an arrow B.

An opening 40 provided on panel 9 is used for supplying the cleaning material into vessel 20. A guide portion 41 formed as a part of the control box guides the cleaning material supplied from the opening 40 to vessel 20.

A V-shaped box 42 consisting of an outer surface **42*a*, inner wall 42*b* and side walls 42*c* is provided adjacent guide portion 41 and its apex 43 is hinged at panel 9. The outer wall 42*a*, the free end of which is received at a recessed portion 9*a* of the panel 9, fits opening 40 as a lid. On each inside surface of the side walls 42, lines 44 are respectively marked for utilizing the V-shaped box 42 as a measuring cup for cleaning material when lid 42*a* is opened. The lid has a grip 45** for opening.

A link rod 50 is pivotably fixed to one of side walls **42*c* and extends to engage with vessel 20. The engagement of rod 50 with vessel 20 is actuated by a longitudinal aperture 51 and a pin 52 which is provided on the side portion of the vessel 20**.

The length of rod 50 is designed so as to engage or suspend vessel 20 with pin 52 as long as lid **42*a* is opened regardless of the disengagement of projection 30 with barb 32**.

The operation of this embodiment is as follows.

After the objects or substances to be washed have been thrown into tub 4 from opening 13, timer 7 in control box 6 is set to a predetermined position or starting position by dial 8 where neither expanded portions 37 or 38 of cam 11 is engaged with cam follower 36 of lever 35. When timer 7 is set to its starting position, water is added to tub 4 from a tap through a water supply valve (not shown) of the washing machine.

Lid 42*a* is opened with the grip 43 in order to supply cleaning material to V-shaped box 42 up to line 44 marked on the inner surface of the wall 42C. The amount of cleaning material of course is dependent upon the amount of the objects to be washed.

By closing lid 42*a* to the opening 40, the material is thereafter supplied to vessel 20 which is held in a horizontal position by engaging projection 30 with barb 32 of the lever 31 when the cam follower 36 is located between the expanded portions 37 and 38 on the periphery of cam 11. The barb 32 thus acts as a latch which is released by cam 11. However, rod 50 which has been moved down in association with the closing of the lid 42*a* is not engaged with the pin 52 provided on the side of the vessel 20.

While adding water to tub 2, the stored cleaning material is dispensed into tub 4 by the tilting vessel 20 when projection 30 is disengaged from barb 32 as expanded portion 37 engages cam follower 36. As described above, rotation of vessel 20 is aided by coil spring 23.

When the water is filled up to a predetermined level in the tub 4, the agitator begins to rotate. A complete washing cycle including washing, first dehydrating, rinsing, and second dehydrating is carried out by the program set by the timer 7 in a conventional manner.

During these operations, another cleaning material for the next cycle can be readily supplied or stored in the vessel 20. When the lid 42*a* is opened by a hand with the grip 43 for this purpose, rod 50 to which wall 42*b* is fixed is pulled up against the force of the spring 23, and the projection 30 of vessel 20 is re-locked with the barb 32 of the lever 31.

At this moment, as the cam follower 36 is located on the periphery between the projected portions 37 and 38 of the cam 11, specifically the periphery X-Y-Z, vessel 20 is returned to the original position where the vessel 20 is kept horizontal for storing cleaning material therein. The cleaning material for the next use is now stored in the vessel 20.

Another embodiment in accordance with the present invention is shown in FIGS. 6 to 14 and explained hereinunder where like reference characters designate identical or corresponding elements of the above-mentioned first embodiment. However, the construction and operation of the second or third embodiment is substantially the same as those of the first; therefore, detailed explanations are not provided.

Referring now to FIG. 6–FIG. 11, lid 42 rotatably mounted on a panel 9 of a control box 6 is fixed to a lever 100 so as to rotate in the same direction as lever 100. The length of lever 100 is designed so as to engage with a projecting member 101 which is formed with vessel 20 for holding vessel 20 in a horizontal position, when lid 42*a* is in opening condition.

Vessel 20 of this embodiment is received in a vessel receiver 102 and is also rotatably supported by side walls 103 thereof with a pair of pins 16. A coil spring 23 is suspended between a rear portion of the vessel 20 and a pillar 24 appended to a rear wall 104 of the vessel receiver 102 in order to urge vessel 20 to rotate about the pins 16.

For the purpose of locking or unlocking the vessel 20, a lever 31 which has a barb 32 in its one end and a projection 30 raised on the vessel 20 are also provided in this second embodiment in the same manner as just mentioned in the first embodiment. Engaging and disengaging the barb 32 with the projection 30 takes place as described above.

A guide member 141 which corresponds to guide portion 41 of the first embodiment is attached to the panel 9 of the control box for guiding the cleaning material from opening 40 to vessel 20.

In this second embodiment is another improvement for preventing adhesion of the cleaning material to vessel 20. A container 150 of which one wall adjacent to the vessel 20 has a cut portion 151 is disposed adjacent to vessel receiver 104. An outlet pipe 152 which is connected to a water supplying valve 153 supplies water to tub 2 through container 150 so that if the vessel 20 is in a tilted position the water flowing from the cut portion 151 is poured into vessel 20. Then, the cleaning material is swept away with the water and vessel 20 is cleaned.

Figure 12:
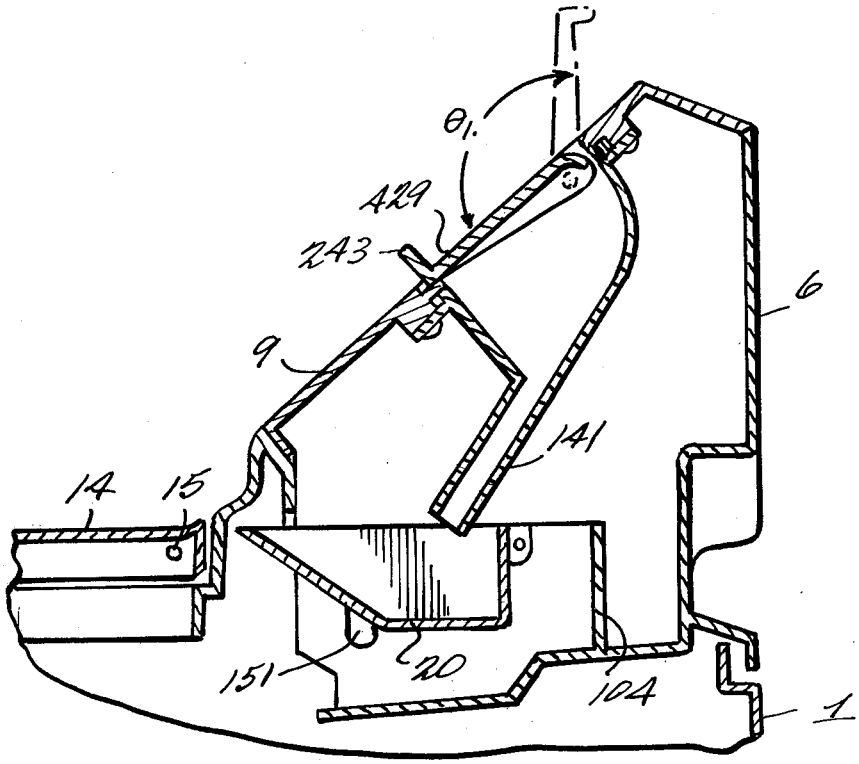

The third embodiment of the present invention, of which sectional views are shown in FIG. 12 to FIG. 14, includes a member 160 comprising a pair of wings 161 and 162 which are rotatably fixed and actuated by the lever 100. Therefore, vessel 20 is held in the horizontal position by engaging wing 162 with lever receiver 101 when lid 42*a* is in open position.

Figure 15:
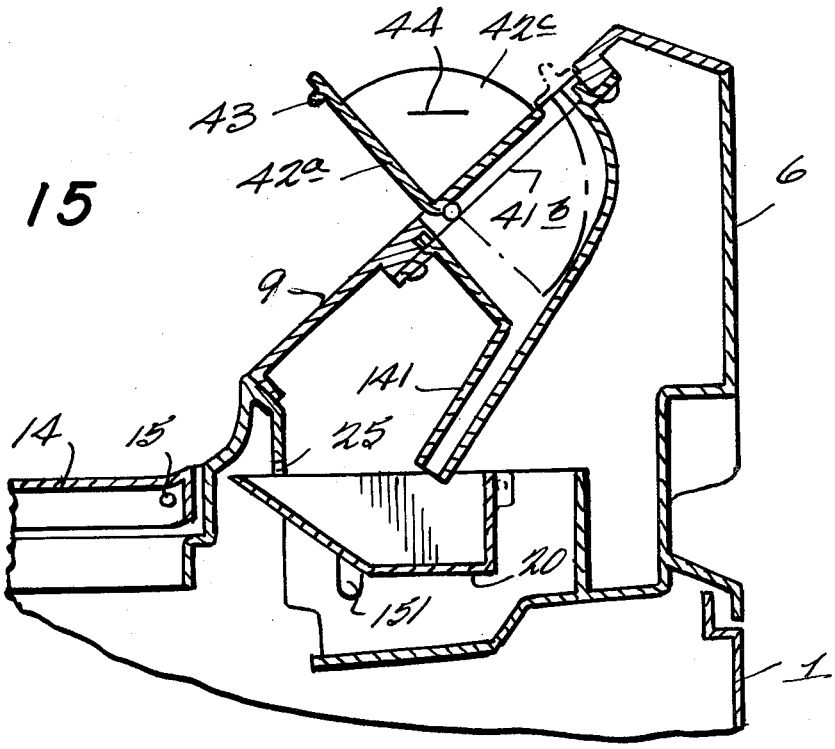
FIG. 15 shows a sectional view of a fourth embodiment of the present invention.

FIG. 15 shows a cross-sectional view of a fourth embodiment of the present invention, which corresponds to FIG. 7; however, the difference between FIG. 7 and FIG. 15 is the use of a V-shaped box 42 in FIG. 15. In the fourth embodiment, V-shaped box 42 stores the cleaning material as explained in the first embodiment.

As described above, in the present invention of cleaning material supplying apparatus, cleaning material is readily stored in the vessel for the subsequent use.

Many changes and modifications of the above described embodiments can, of course, be carried out without departing from the scope of the present invention, that scope being intended to be limited only by the scope of the appended claims.

What is claimed is:

1. An apparatus for dispensing cleaning material into a washing apparatus comprising:

a housing having an opening for receiving cleaning material;

a vessel mounted in said housing for receiving and storing cleaning material passing through said opening;

means for pivotably mounting said vessel for movement between a horizontal position storing said material and a dispensing position in which material in said vessel is dispensed;

resilient means connected to said vessel for urging said vessel toward said dispensing position;

latch means engagable with said vessel for maintaining said vessel in said horizontal position when engaged with said vessel;

means for releasing said latch means during operation of said washing apparatus so that said vessel moves into said dispensing position;

lid means pivotably mounted on said housing for movement between a closed position closing said opening and an open position in which said material can be placed in said opening; and means connecting said lid and vessel for returning said vessel to said horizontal position when said lid is moved to said open position.

2. An apparatus as in claim 1, wherein said returning means includes a rod pivotably mounted at one end to said lid means and having a longitudinal aperture therein and a pin extending from and attached to said vessel for sliding movement in said aperture and engaging said rod for returning said vessel to said horizontal position.

3. An apparatus as in claim 1, wherein said returning means includes a rod fixed to said lid for pivotal movement therewith and a projecting member of said vessel for engaging said rod for returning said vessel to said horizontal position.

4. An apparatus as in claim 1, wherein said returning means includes a rod fixed to said lid for pivotal movement therewith, a member pivotably connected to said housing and having a pair of wings extending from the point of pivot, one of said wings engaging said rod when said lid is opened for pivoting said member and a projection of said vessel for engaging the other of said wings for returning said vessel to said horizontal position.

5. An apparatus as in claim 1, 2, 3 or 4, wherein said latch means includes a projection on said vessel and a lever having a barb at one end for engaging said projection and wherein said releasing means includes a cam follower member connected to said lever and adapted for engaging a cam operated by a timer of said washing apparatus.

6. An apparatus as in claim 1, 2, 3 or 4, wherein said lid means includes a container for receiving said material when said lid means is in said open position and dumping said material into said vessel when said lid is in said closed position.

7. An apparatus as in claim 1, wherein the returning means includes a rod fixed to said lid for movement with said lid means between a first position permitting said vessel to pivot to said dispensing position when said lid means is in said closed position and a second position preventing said vessel from pivoting to said dispensing position when said lid is in said open position.

8. A washing apparatus comprising:

a tub for receiving articles to be washed;

timer means for causing said apparatus to carry out a washing cycle; and means for dispensing cleaning material including:

a housing having an opening for receiving cleaning material;

a vessel mounted in said housing for receiving, and storing cleaning material passing through said opening, and dispensing said material into said tub;

means for pivotably mounting said vessel for movement between a horizontal position storing said material and a dispensing position in which material in said vessel is dispensed;

resilient means connected to said vessel for urging said vessel toward said dispensing position;

latch means engagable with said vessel for maintaining said vessel in said horizontal position when engaged with said vessel;

means for releasing said latch means during operation of said washing apparatus so that said vessel moves into said dispensing position;

lid means pivotably mounted on said housing for movement between a closed position closing said opening and an open position in which said material can be placed in said opening; and means connecting said lid and vessel for returning said vessel to said horizontal position when said lid is moved to said open position.

* * * * *